US011515066B2

(12) United States Patent
Kassen et al.

(10) Patent No.: US 11,515,066 B2
(45) Date of Patent: Nov. 29, 2022

(54) HEAT TREATABLE MAGNETS HAVING IMPROVED ALIGNMENT THROUGH APPLICATION OF EXTERNAL MAGNETIC FIELD DURING BINDER-ASSISTED MOLDING

(71) Applicant: Iowa State University Research Foundation, Inc., Ames, IA (US)

(72) Inventors: Aaron G. Kassen, Wyomissing, PA (US); Iver E. Anderson, Ames, IA (US); Emma Marie Hamilton White, Ames, IA (US); Matthew J. Kramer, Ankeny, IA (US); David J. Byrd, Boone, IA (US); Liangfa Hu, San Jose, CA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 358 days.

(21) Appl. No.: 16/350,363

(22) Filed: Nov. 7, 2018

(65) Prior Publication Data

US 2019/0244734 A1 Aug. 8, 2019

Related U.S. Application Data

(60) Provisional application No. 62/707,598, filed on Nov. 9, 2017.

(51) Int. Cl.

| | |
|---|---|
| ***H01F 1/08*** | (2006.01) |
| ***H01F 7/02*** | (2006.01) |
| ***H01F 41/02*** | (2006.01) |

(52) U.S. Cl.
CPC ..... *H01F 1/086* (2013.01); *H01F 7/021* (2013.01); *H01F 41/0273* (2013.01)

(58) Field of Classification Search
None
See application file for complete search history.

(56) References Cited

U.S. PATENT DOCUMENTS 5,250,255 A * 10/1993 Sagawa ..... B22F 3/003 419/38
6,187,259 B1 * 2/2001 Yamashita ..... H01F 1/0577 419/12

OTHER PUBLICATIONS

Anderson, J. Appl. Phys., vol. 117, No. 17D138. (Year: 2015).*
Anderson, I.E. et al. Highly tuned gas atomization for controlled preparation of coarse powder, Mat.-wiss. U. Werkstofftech, 41, No. 7, 2010.

(Continued)

*Primary Examiner* — Xiaowei Su

(57) ABSTRACT

Improved manufacturing processes and resulting anisotropic permanent magnets, such as for example alnico permanent magnets, having highly controlled and aligned microstructure in the solid state are provided. A certain process embodiment involves applying a particular orientation and strength of magnetic field to loose, binder-coated magnet alloy powder particles in a compact-forming device as they are being formed into a compact in order to preferentially align the magnet alloy powder particles in the compact. The preferential alignment of the magnet alloy powder particle is locked in place in the compact by the binder after compact forming is complete. After removal from the device, the compact can be subjected to a subsequent sintering or other heat treating operation.

17 Claims, 11 Drawing Sheets

(56) References Cited

OTHER PUBLICATIONS

Durand-Charre, et al., Relation Between Magnetic Properties and Crystallographic Texture of Columnar Alnico 8 Permanent Magnets, IEEE Transactions On Magnetics, vol. Mag-14, No. 5, Sep. 1978.
Makino, Noboru, et al., Techniques to Achieve Texture in Permanent Magnet Alloy Systems, Journal of Applied Physics, vol. 36, No. 3, Mar. 1965.
Bachlechner, A., et al., A New Instrument for T•Testing Charge—*Sign Dependent Modulation, Proceedings of the 31 st ICRC*, pp. 1, 2009.
Bjork, R., et al., Comparison of adjustable permanent magnetic field sources, Journal of Magnetism and Magnetic Materials, 322, 3664-3671, 2010.
Standard Specifications For Permanent Magnet Materials, MMPA Standard No. 0100-00, 2000 edition.

* cited by examiner

HEAT TREATABLE MAGNETS HAVING IMPROVED ALIGNMENT THROUGH APPLICATION OF EXTERNAL MAGNETIC FIELD DURING BINDER-ASSISTED MOLDING

RELATED APPLICATION

This application claims benefits and priority of provisional application Ser. No. 62/707,598 filed Nov. 9, 2017, the entire disclosure and drawings of which are incorporated herein by reference.

CONTRACTURAL ORIGIN OF THE INVENTION

This invention was made with government support under Contract No. DE-AC02-07CH11358 awarded by the U.S. Department of Energy. The government has certain rights in the invention.

FIELD OF THE INVENTION

The present invention relates to heat treatable permanent magnets, such as alnico permanent magnets, having highly controlled and aligned microstructure in the solid state.

BACKGROUND OF THE INVENTION

Alnico alloys comprise as major alloying components Al, Ni, Co, and Fe and are widely used in the production of magnets for many applications. Alnico magnets can exhibit anisotropic or isotropic magnetic properties as a result of different processing and chemistry.

Alnico alloys are widely commercially available in various grades, such alnico 8 and 9, that are made by different processing such as powder metallurgy, sintering, or casting.

Complicated labor-intensive directional solidification is the current commercial method for producing grain-aligned alnico 9 magnets with the best existing energy density.

Typical methods for achieving an aligned microstructure in the heat treatable alnico permanent magnet alloys typically rely on costly directional solidification, zone refinement, or other energy and time intensive processes as well as use of epoxy, polymer, or other binder material that remains in the magnet after processing.

There is a need for an improved manufacturing process of such heat treatable magnets in order to reduce the time, cost, and material resources as compared to these standard methods for achieving an aligned microstructure that yields beneficial or improved magnetic properties, such as improved coercivity and high magnetic saturation to provide a higher energy product to improve magnet performance in motors and generators, compared to magnets produced using these standard processes.

SUMMARY OF THE INVENTION

The present invention addresses this need by providing improved processing and resulting permanent magnets, such as for example alnico permanent magnets, having highly controlled and aligned microstructure in the solid state by compacting magnet alloy particles in the presence of a particle binder and in the presence of a magnetic field that preferentially aligns the particles to form a compact in which the preferential alignment of the particles is locked in place by the binder followed by heat treating the compact to achieve grain growth in a direction of the preferential alignment within at least a portion of the volume of compact.

An illustrative embodiment involves compacting loose, binder-coated magnet alloy particles in the presence of a magnetic field that preferentially aligns the particles to form a compact in which the preferential alignment of the particles is locked in place by the binder in the completed compact followed by subjecting the compact to sintering under sintering conditions to achieve grain growth in the direction of the preferential alignment within at least a portion of the volume of the compact sufficient to improve magnetic properties.

An illustrative embodiment of the present invention involves applying a magnetic field of specific orientation and relatively low strength, such as typically about 1.0 Tesla or less, to loose, binder-coated magnet alloy powder particles in a compact-forming device to orient and magnetically hold the powder particles in desired preferential alignment during compacting to form a completed compact in which the preferential alignment of the particles is locked in place by the binder, thereby establishing a microstructural template that is retained for subsequent solid state grain growth during a later sintering process. The magnetic field preferably is applied at the beginning of compacting of the powder particles in the device; i.e., before any compacting force is applied, until the preferential alignment is locked in place by the binder in the completed compact. After compact formation, the resulting compact is subjected to a thermal de-binding treatment followed by a sintering process at a high temperature in the solid solution regime of the magnet alloy under conditions to achieve solid state grain growth in the direction of preferential alignment (the pre-established template) within at least a portion of the volume of the sintered compact sufficient to provide improved magnetic properties.

The compact optionally may undergo application of additional techniques such as uniaxial stress loading during the final sintering to further enhance this microstructural alignment effect by further solid state grain growth, even to the extent of making substantially single crystal magnet shapes or bodies of alnico alloys or other alloy systems by powder processing to near-final shapes.

Achievement of superior magnetic properties may be achieved by control and selection of parameters for magnetic annealing and draw annealing that are performed on the aligned magnet microstructure after the solid state grain growth step to provide the optimum coercivity and saturation magnetization. Practice of the invention to improve coercivity and saturation magnetization can also involve modified magnet alloy compositions.

Generally, highly textured anisotropic alnico magnets made by practice of this invention, along with optimized coercivity and magnetization, can achieve greatly enhanced energy density or maximum magnetic energy product and the capability for high volume manufacturing due to the advantages of powder processing to near-final shapes.

Practice of the present invention is significantly more efficient in terms of time, cost, and material resources as compared to typical methods for achieving an aligned microstructure in such heat-treatable permanent magnet alloys, which typically rely on costly directional solidification, zone refinement, or other energy and time intensive processes. Further, practice of the present invention is advantageous in that no epoxy, polymer, or other binder material remains in the magnet to dilute the magnetic properties after processing.

The present invention and advantages thereof will be described in more detail below with respect to certain embodiments of the present invention offered for purposes of illustration and not limitation in relation to the following drawings.

DETAILED DESCRIPTION OF THE INVENTION

Figure 1:
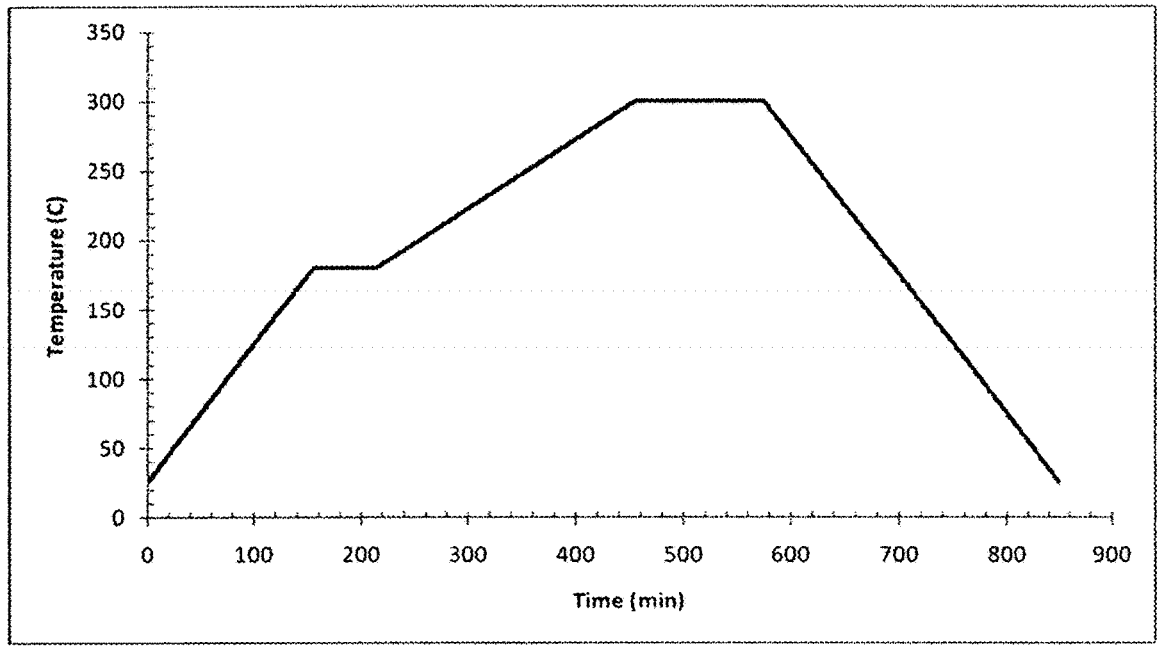
FIG. 1 illustrates a de-binding heating curve used for pressed green body samples to produce brown bodies. Each brown body was sintered using a three-stage sintering curve with preliminary holds at 250° and 600°, along with final sintering at 1250° C. (within the single phase solid solution region for this alloy) for 1 to 12 hours and slowly cooled (furnace power turned off) under a vacuum of approximately $5(10^{-6})$ torr to produce a uniformly densified compact. The preliminary holds at 250° C. and 600° C. ensure removal of any residual binder in an open porosity state before surface access was sealed by densification during isothermal sintering at 1250° C.

A certain embodiment of the present invention offered for purposes of illustration and not limitation embodies an improved manufacturing process that focuses on the initial compacting process for final-shape magnets wherein a magnetic field of particular orientation and strength is applied to loose, binder-coated, magnet alloy particles in a compact-forming device in order to preferentially align the magnet alloy particles during compacting to form a compact in which the preferential alignment of the particles is locked in place by the particle binder in the completed compact. The magnetic field preferably is applied at the beginning of compacting of the particles before any compacting force is applied to the particles until the preferential alignment is locked in place by the binder in the completed compact. The binder-coated particles can be heated or not heated during compaction. The binder coating can comprise an epoxy, a polymer or other binder that can bind and hold the particles in preferential alignment in the completed compact. Suitable binders include, but are not limited to, polypropylene carbonate (PPC) or other polymer compounds that are known to evaporate during thermal debinding without leaving traces of carbon behind in the microstructure. The binder is selectively removed from the compact before high temperature sintering with the pre-established preferential alignment retained by the compacted, mechanically keyed particles.

The magnetic field can be applied by permanent magnets, a solenoid, or other magnetic field generating device appropriately positioned relative to the compact-forming device to this end.

The present invention can be practiced using magnet alloy particles comprising alloys of the aluminum-nickel-cobalt-iron type permanent magnet alloys having a body centered cubic crystal structure. Such alloys include, but are not limited to, commonly referred to alnico alloys, an illustrative one (alnico 8) that includes (wt. %) 7.1% Al, 13.0% Ni, 40.1% Co, up to 3.0% Cu, up to 6.5% Ti, up to 0.5% Nb, and balance substantially Fe and incidental impurities. Such alnico alloys include, but are not limited to alnico 5, 5-7, 8 and 9 alloys. In certain embodiments, alnico alloys can have a composition, in wt. %, of about 7 to about 8% Al, about 13 to about 15% Ni, about 24 to about 42% Co, up to about 3% Cu, up to about 8% Ti, and balance Fe and incidental impurities. The present invention also can be practiced using other heat-treatable permanent magnet alloy systems that are characterized by a high temperature single phase solid solution and a reduced temperature phase transformation that can be tuned to maximize the magnetic properties.

A certain method embodiment for making a 3D (three dimensional) compact involves conducting an initial compression molding or injection molding step of fine, spherical, powders that promote rapid sintering to a fine-grained equi-axed starting microstructure with a density of greater than about 97% of theoretical density, i.e., essentially full density. The precursor powder particles can be polycrystalline particles or single crystalline particles, or a mixture of both, which are introduced into a compacting (molding) die (e.g. a compression molding die or injection molding die). In addition to a high driving force for sintering, the precursor powder particles will have a typical fine particle diameter of less than 25 μm and preferably even finer particle diameter of less than about 10 μm having the smallest number of grains within each particle sphere, making the field alignment torque most effective. A typical powder particle size range is from 1 μm to 25 μm diameter. The ultimate extent of this magnetic alignment effect would be achieved during compression molding of single crystal spheres that occur normally in powders that are smaller than about 5 μm diameter. The invention envisions using other particle compacting techniques providing load consolidation to compress the particles together in a compacting direction in the presence of a binder and of a magnetic field to make 3D (three dimensional) and 2D (two dimensional) compact shapes. For example, for purposes of illustration only, cold isostatic compaction could also be employed to make 3D compact shapes using an external magnetic field that is established in a pressurized fluid filled compaction chamber. So-called tape casting and bonded sheet molding/rolling/pressing to provide particle compaction could be used to make 2D compact shapes.

It is also preferred that the starting spherical powder for the initial molded magnet shapes have a typical extremely thin oxide surface coating beneath the particle binder to promote rapid sintering and to minimize the effectiveness of any oxide pinning sites (that arise from breakup and coarsening of the oxides on prior particle boundaries) that could inhibit grain growth during sintering to full density. The dimensions of the die set to form the magnet shapes from powders also should be designed with a uniform dimensional dilation to account for solvent and binder removal, as well as the proper densification shrinkage to near-final magnet dimensions. Further orientation considerations can be made to desired alignment with respect to desired magnetic pole direction of the final product and the applied magnetic field direction. It is in this condition that the next stage of microstructure control will be exercised. It should be noted that there may be a need in the molding die for some additional minor dimensional inflation to account for any small losses from final grinding of the surfaces.

Grain Growth:

After the initial templating has occurred in the compact-forming device and following removal from the compact-forming device, the green compact (preferentially) is subjected to de-binding and a heat treating process (e.g. sintering process), in the case of alnico, in the high temperature single phase solid solution temperature regime. The heat treatment during this time gives sufficient time and temperature for grain boundary mobility to result in significant grain coarsening eventually leading to a beneficial abnormal grain growth condition. The abnormal grain growth, normally random in nature, occurs in a controlled methodical way due to the prior templating, which occurred during compaction under the applied magnetic field and which is mechanically keyed in place after binder removal without being disturbed (preferentially) as a result of the prior particle compaction (e.g. compression molding). The result of the combined effect (templating followed by grain growth) is a microstructure with a dominant orientation that correlates well to the applied magnetic field direction throughout at least a portion, preferably substantially all, of the bulk sample (bulk sample volume) sufficient to achieve improved magnetic properties.

Once the resulting dominant orientation is predictable, a relationship between the dominant orientation, and the required magnetic field orientation can be established, and by changing the applied field direction, one can template and create orientation in the desired direction of the sintered net shape magnet. The direction for application of the applied magnetic field must be decided based on the desired final magnetization direction for each application, i.e., when subjected to subsequent magnetic annealing (MA), the crystallographic alignment must be parallel (or near-parallel) to the magnetization direction of the external field to achieve the maximum coercivity effect, especially in alnico-type magnets that rely on shape anisotropy for a major part of their coercivity.

According to the present invention, a microstructure can be biased to grow in a direction correlated to an applied magnetic field due to templating of the initial orientation of starting constituent powder particles of the compact. Although it is still possible to grow grains that are oriented at different directions to the field direction, this invention relies on a confinement effect provided by the exterior of the magnet shape and a preponderance of similarly oriented starting grain orientations of the compact to promote selection of a single direction for grain growth that is close to the ideal.

The initial, locked-in-place magnetic alignment of the loose, binder-coated particulate can be further enhanced through the application of a uni-axial loading during final sintering as shown/described in FIG. 12 and in pending U.S. patent application Ser. No. 15/530,951, US publication No. 2017/0283893 A1, the teachings of which are incorporated herein by reference. Selection of a sufficient dead weight load (or constant uniaxial stress) is made such that the stress is high enough to effectively bias the crystallographic direction of the desired abnormal grain growth (AGG) that is driven throughout at least a portion, preferably a majority, of the volume of the magnet shape. The uni-axial stress can fine tune the prior templated orientation in the resulting microstructure. This applied load can occur at any time after initial densification of the compression or injection molded body depending on the desired result of minimal deformation and minor changes to the resulting microstructure or larger deformation combined with significant modification of the resulting orientations. As mentioned above, the direction for application of the uni-axial compaction load must be decided on the basis of the desired final magnetization direction for each application, again ensuring optimal microstructural orientation with respect to bulk magnet formation.

Full density is important if a final grain growth process promoted by uniaxial loading is desired to ensure that no internal voids interrupt the desired grain growth direction during the AGG process. Fine grained equi-axed microstructures permit fixed stress vectors to be transmitted without dissipation (from collapsing of void concentrations) throughout the entire volume of the magnet shape.

The fine grain size of the magnet alloy precursor alloy powder particles is important to promote enhanced grain growth kinetics and to increase the probability of selection of a preferred direction for abnormal grain growth for maximum magnetic properties. Selection of the proper temperature for this grain growth process is linked to the operating phase diagram for these typically complex magnet alloys (e.g., alnico 8) and the need to be within a high temperature single phase region to promote uniform composition and rapid diffusional mobility of the grain boundaries without obstruction from secondary phases. If the temperature is too low, it may be possible to accomplish the controlled AGG process, but the time needed for completion could be too long for practical processing. The time required for completion of the AGG process of this invention must be determined for each magnet alloy composition and magnet shape and size although the kinetics of the process are similar for a given magnet alloy and starting microstructure since the AGG process preferably should consume most of the volume of the magnet during the treatment. The time is sufficient when grain growth has eliminated the vast majority of the initial fine grains, promoting either a single crystal magnet shape or one in which only greatly enlarged grains (mm-sized) remain that are all aligned within a small angular mismatch from the ideal crystallographic direction for maximum magnetic properties, especially remanence (Br), remanence ratio (Br/Msat), and squareness of the hysteresis loop. One additional advantage of the completed grain-aligned magnets that must be mentioned is the ability to use a moderate cooling rate on the samples, i.e., the need to quench from the B2 solutionizing temperature to avoid excessive gamma phase formation (that forms preferentially on grain boundaries in alnico 8 and 9) is eliminated since nearly all of the grain boundary area has been eliminated. Of course, some reasonable attempt should be made to accelerate cooling through the spinodal transformation temperature range to prevent full formation of the final partitioned microstructure, since the spinodal transformation should be completed to the desired nano-structure dimensions during subsequent magnetic annealing.

As mentioned, to permit the maximum level of magnetic properties to be achieved in a magnet shape that has been fully processed by the highly controlled solid-state AGG process, the magnetic annealing process and the subsequent draw annealing processes should also be properly performed. These processes should be performed with the selected parameters that had been previously empirically determined to maximize the coercivity (Hci) and saturation magnetization (Msat) of the specific magnet alloy. It should be noted that each specific magnet shape and size may have a unique set of thermal treatment parameters, again because of the different volume of the magnet since thermal diffusivity (conductivity) will affect the ability to achieve a desired uniform temperature. At least the full density of these AGG aligned magnets permits simple computation of the adjustments needed to vary the thermal treatments after thermal diffusivity measurements have been made on samples of post-AGG magnets.

The following examples are offered to describe and illustrate the invention in more detail without limiting the scope of the invention. Although rod-like magnet shapes are described in the examples set forth below, the present invention can be practiced in connection with various other magnet shapes of commercial interest to impart a grain-aligned microstructure. Moreover, although the examples employ alnico 8 alloy samples, alnico 8 alloy is employed for purposes of illustration of the invention and not of limitation.

EXAMPLES

Comparison Experimental Procedure for Powder Processed Samples without Magnetic Templating:

High commercial purity (99.99%) elemental additions were melted and atomized to create an alnico 8 based pre-alloyed powder using a close-coupled gas atomization system with the desired composition of: 7.3 Al-13.0 Ni-38 Co-32.3 Fe-3.0 Cu-6.4 Ti (wt. %) [atomizing described in U.S. Pat. No. 5,125,574 and reference 1 both incorporated herein by reference]. The 3,500 g charge was melted, homogenized, and superheated to a temperature of 1625° C. before pouring and atomizing with high purity argon gas at 2.93 MPa (425 psi) of supply pressure. The resultant powder was riffled and screened from −106 μm and down using standard ASTM size cuts and a representative sample was sent for chemical analysis (NSL Analytical), which verified the desired composition within 0.1% for all alloy components. Laser diffraction particle size distribution analysis (Microtrac®) was used to characterize the powder and SEM (JEOL 5910) analyzed the final powder shape and "satellite" content.

Size cuts from the resulting powder were either used individually or combined to make 100 g of powder particles either a blend, i.e., 90 wt. % 32-38 μm+10 wt. % 3-15 μm, or top cut at 20 μm in particle size. This powder was mixed in a multi-axis (TURBULA®) blender and compounded by mortar and pestle with a low-residual impurity polypropylene carbonate (PPC) binder (QPAC® 40) that had been dissolved in acetone to create a 6 wt. % solution for compounding. This created a final loading of 2.6 vol. % binder in the final binder-coated powder that was dried in air to evaporate excess acetone for 24 hours.

Samples, containing approximately 4.3 g of the final binder-coated powder particles, were loaded into a compression die (unheated) by hand with a spatula and pressed in that 9.525 mm diameter die at 156 MPa without a magnetic field being applied. After removal from the compression die, each resultant green body underwent a two stage debinding procedure in air with isothermal holds to decompose the PPC binder at 180° and 300° C., followed by a furnace cool to produce a brown body for sintering. De-binding temperatures were determined for the PPC binder by differential scanning calorimetry to identify decomposition behavior, with 180 degrees C. selected to ensure the slowest possible decomposition. This allowed retention of the initial open porosity in order to facilitate complete decomposition and outgassing by the time the sample reached 300° C. to avoid trapped gas porosity. FIG. 1 shows the de-binding curve used for pressed green body samples to produce brown bodies.

Figure 2:
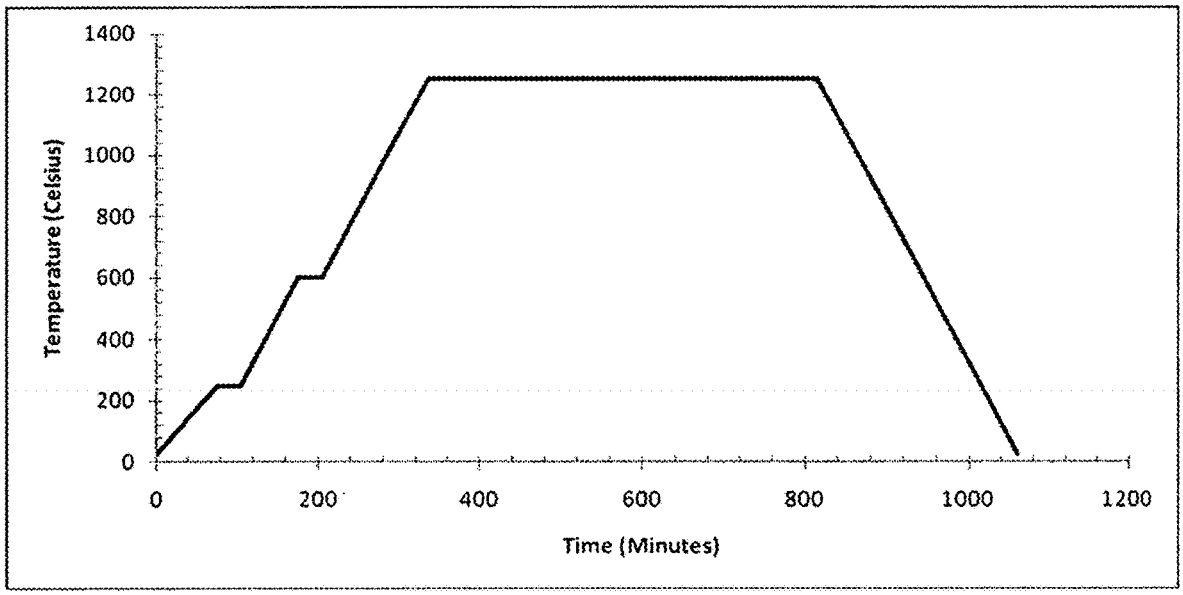
FIG. 2 illustrates a brown body sintering curve to produce fully sintered samples, illustrating an 8 hour sintering hold.

Each brown body was sintered using a three-stage sintering curve, FIG. 2, with preliminary holds at 250° and 600°, along with final sintering at 1250° C. (within the single phase solid solution region for this alloy) for 1 to 12 hours and slowly cooled (furnace power turned off) under a vacuum of approximately $5(10^{-6})$ torr to produce a uniformly densified compact. The preliminary holds at 250° C. and 600° C. ensured removal of any residual binder in an open porosity state before surface access was sealed by densification during isothermal sintering at 1250° C. Zirconium turnings were placed around the sample as gettering material for any furnace outgassing species, and the sample was covered loosely by an alumina crucible to shield it from deposition of other possible contaminants from furnace surfaces.

Figure 3:
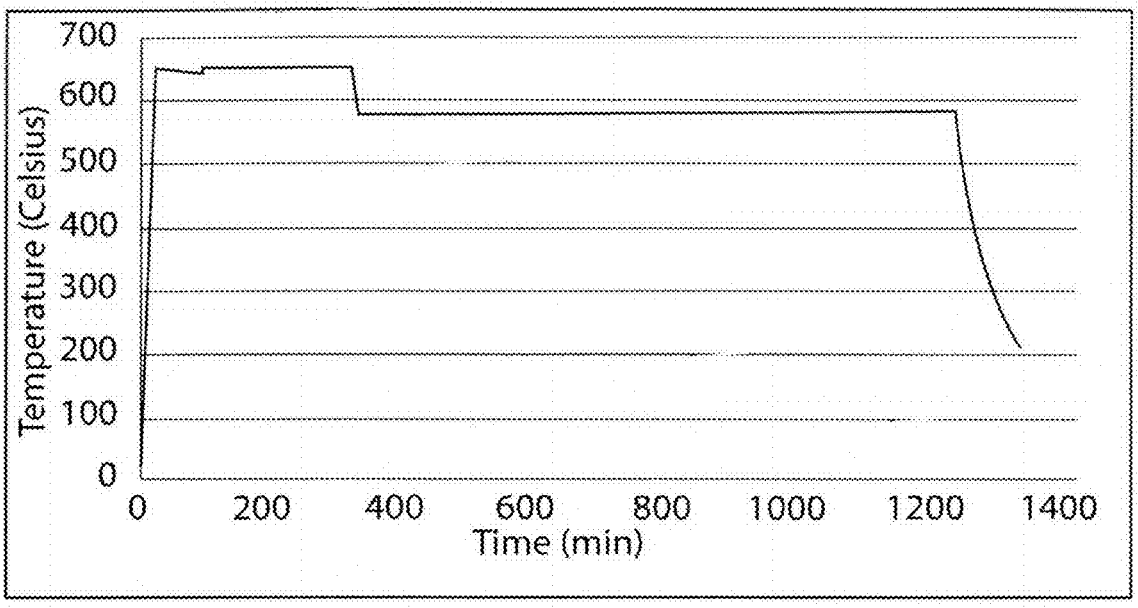
FIG. 3 shows the temperature profile of draw annealing cycles at 650° C. for 5 hours and 580° C. for 15 hours resulting in full heat treatment.

After magnet sample rods were cut from each sintered compact by electro-discharge machining (EDM) and ground to smooth finished dimensions (3 mm diameter×8 mm height), selected rods underwent further heat treatments that had been developed for very similar alnico alloys to establish the appropriate nanostructure for the full development of magnetic properties. First, each rod was subject to a "re-solutionizing" heat treatment at 1250° C. under a vacuum of at least $5(10^{-6})$ torr for 30 minutes to "reset" the microstructure to a B2 solid solution and quenched in silicone oil to room temperature to retain as much of the solid solution as possible. Each rod sample was solvent cleaned and sealed in quartz under vacuum and subject to magnetic annealing under a 1 Tesla field at 840° C. for 10 minutes to promote aligned spinodal transformation. Annealing ("draw") cycles were performed in an air atmosphere furnace at 650° C. for 5 hours and 580° C. for 15 hours to produce a fully heat treated condition (FHT) for each sample. FIG. 3 shows the temperature profile of draw annealing cycles at 650° C. for 5 hours and 580° C. for 15 hours resulting in full heat treatment (FHT).

Magnetic measurements of the FHT specimens were performed using a closed-loop Laboratorio Elettrofisico AMH-500 hysteresigraph under a maximum applied field of 15 kOe. FE-SEM analysis, using an Amray 1845 or, later, an FEI Quanta 250, both fitted with electron backscattered diffraction (EBSD) systems, was performed to confirm the grain size and analyze the microstructure of each final sintered and FHT sample.

TABLE 1

Magnetic properties of sintered alnico specimens at various times, compared to a standard alnico 8 magnet.

| Sample | Br G | Hci Oe | Hc Oe | BHmax MGOe | Hk Oe | Sq'ness Hk/Hci | Remanence Ratio Mr/Msat |
|---|---|---|---|---|---|---|---|
| 1 h Sinter | 8,523 | 1,632 | 1,521 | 4.87 | 459 | 0.28 | 0.72 |
| 4 h Sinter | 8,789 | 1,685 | 1,569 | 5.04 | 483 | 0.29 | 0.75 |
| 8 h Sinter, Sample 1 | 10,052 | 1,688 | 1,608 | 6.5 | 601 | 0.36 | 0.85 |
| 8 h Sinter, Sample 2 | 9,725 | 1,735 | 1,655 | 6.4 | 592 | 0.34 | 0.83 |
| 12 h Sinter | 8,626 | 1,645 | 1,530 | 4.85 | 452 | 0.27 | 0.73 |
| MMPA Std 8HC Sintered | 6,700 | 2,020 | 1,800 | 4.5 | — | — | — |

The improved properties of the two 8 hour sintered samples, especially the remanence ratio and enhanced squareness values, lead to the conclusion that abnormal grain growth and an enhanced texturing effect was occurring within these samples. Specifically, it is understood that improved magnet texturing can enhance remanence ratio and loop squareness dramatically, which can lead to increased remnant magnetization, as observed. This is often reported as the Mr/Msat or remanence ratio value, which for a typical unaligned equi-axed alnico magnet is typically on the order of 0.72. However, in the 8 hour samples of Table 1, the remanence ratio was observed to be much higher, 0.83-0.85. Combined with the squareness values of 0.36 and 0.34, respectively, it was likely that some amount of grain alignment must have occurred. For comparison, squareness values for highly aligned magnets, such as directionally solidified alnico 9, can reach as high as 0.95 or higher and remanence ratios approach 0.9, depending on the quality of the casting.

Figure 4:
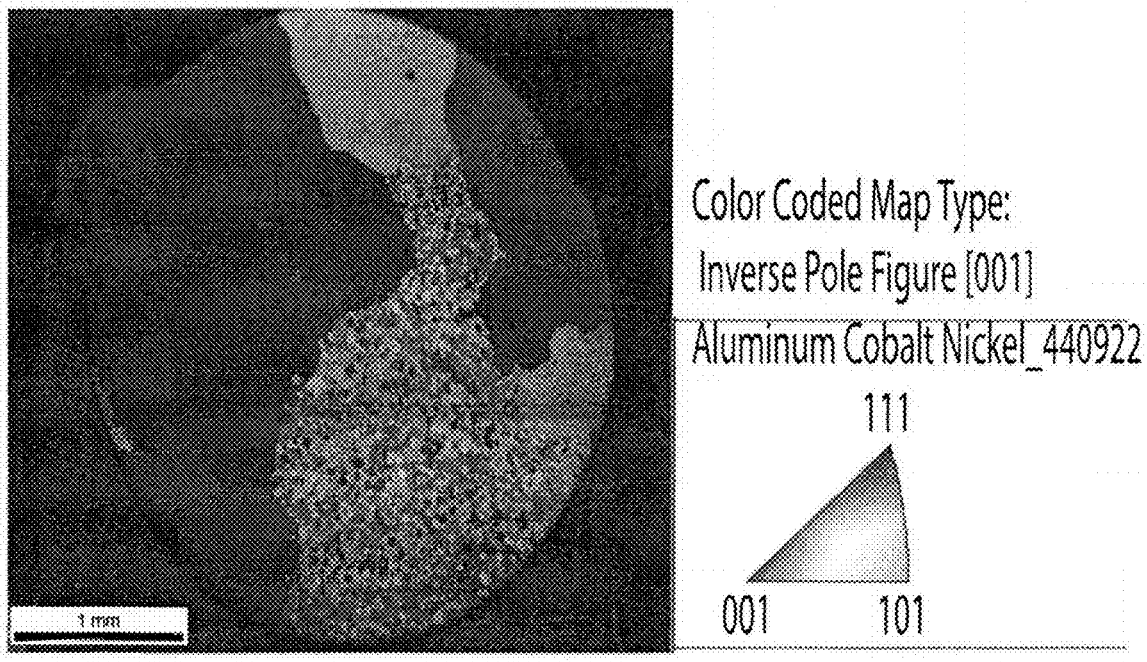
FIG. 4 shows a EBSD ND illustration of a transverse section of 8 hour sintered sample showing significant preferential grain orientation. An inverse pole map (not shown) also showed significant preferential grain orientation.
Figure 5:
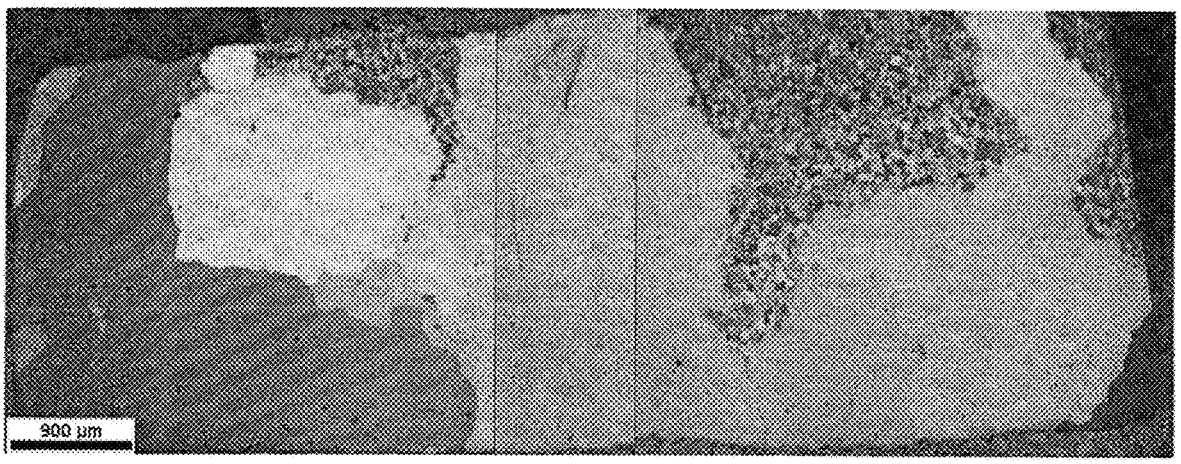
FIG. 5 illustrates EBSD (ND) longitudinal section of 8 hour sintered as a mosaic of three images, combined together to show total area.

To verify that alignment had occurred in the two 8 hour sintered samples by an "accidentally" aligned abnormal grain growth mechanism, as suggested by the magnetic properties and SEM results, EBSD (electron backscatter diffraction) analysis was performed on the polished transverse (FIG. 4) and longitudinal (FIG. 5) sections of one of the 8 hour sintered rods. Analysis of the EBSD results clearly showed that the transverse section was populated heavily by large grains, many of which were oriented preferentially near the <111> orientation (FIG. 4) and near the <101> orientation (FIG. 5) to the sample normal direction (ND).

Secondarily, a significant portion of equi-axed randomly oriented grains remained, covering approximately ⅓ of the sample surface. The longitudinal section also showed significant areas of the sample oriented both near the <101> and <001> directions to the sample ND. Further analysis on the tilt direction (TD) of the longitudinal section sample, parallel to the magnetic axis of the sample, showed that approximately 20% of the sample was aligned on an <001> direction, within a maximum of 15 degrees off-axis. According to Durand-Charre, this is close enough to optimal <001> that significant contributions to the final energy product would still be realized over the baseline magnet. [reference 2] Thus, it was concluded that "accidentally" aligned abnormal grain growth was observed in at least two samples after sintering beyond 4 hours and that this provided magnetic property benefits. It was considered that the 4 hour sintered (99.6% dense) condition would provide an excellent starting condition for production of highly aligned magnets with further improved magnetic properties if control could be exercised over the solid-state grain growth process to align it with a preferred crystallographic direction.

Example 1—Permanent Magnetic Field-Assisted Compression Molding to Achieve Controlled Particle Alignment Using an applied magnetic field during initial binder-assisted compression molding, a starting powder template was created that produced an aligned microstructure. Powder size selection was the same as that used in the prior non-templated (no magnetic field) comparison experiments above consisting of 90 wt. % 32-38 μm+10 wt. % 3-15 μm particle sizes.

This powder was mixed in a multi-axis (TURBULA®) blender and compounded by mortar and pestle with a low-residual impurity polypropylene carbonate (PPC) binder (QPAC® 40) that had been dissolved in acetone to create a 6 wt. % solution for compounding. This created a final loading of 2.6 vol. % binder in the final binder-coated powder that was dried in air to evaporate excess acetone for 24 hours.

Figure 6:
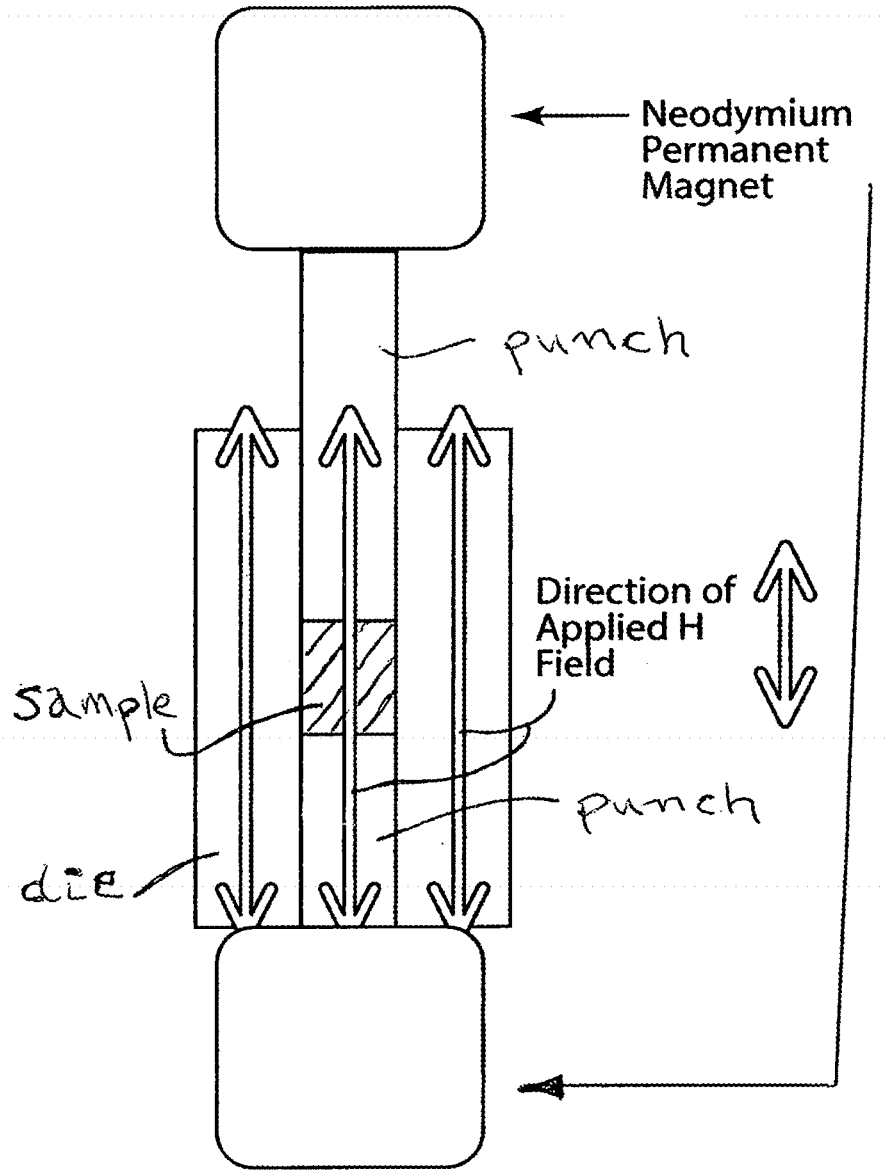
FIG. 6 is a schematic cross section of an applied field texture apparatus for producing templating in compression molded green compacts.

The final binder-coated powder was loaded in the compression die by hand with a spatula. After the final powder was loaded in the compression die for uni-axial load consolidation, a magnetic field was applied by two "grade N52" neodymium-iron-boron based magnets that were placed on the ends of the top and bottom opposing steel punches as shown in FIG. 6 (only one punch shown). The die body itself was non-magnetic and the punch rods allowed the magnetic flux to be carried to the powder in the die, creating a north-south type orientation between the ends of the two punches so that the magnetic field is present at the beginning of the compacting process. The resulting measured field was approximately 0.25 T in the die cavity during the compression molding or green body forming stage. The powder was seen visibly to align in the chain style orientation. This appears to cause dominant grains to align particle-to-particle in the as-atomized spherical alnico powder and to create the "magnetic templating" in the green body. By using loose binder-coated particles rather than typical alnico "chips" as were utilized in other compression molding processes, individual particle mobility is created through rotation and sliding, creating effective magnetic chains in a classic "north pole-to-south pole" chain design. Further enhancement of the particle-particle mobility was achieved through physical stimulation of the loose powder through die vibration induced by tapping on the side of the die with a metal rod.

After the magnetic field was applied and particle templating occurred, the sample was pressed in a 9.525 mm diameter die (unheated) at 156 MPa with the magnetic field still applied, followed by release of the applied load before magnet removal and sample ejection and processing.

If die heating had been used (see example 2), the die is first allowed to cool to room temperature (below the glass transition temperature of the PPC binder) under applied load before magnet removal, and sample ejection and processing.

The sample underwent thermal debinding and sintering heat treatments (described above) to achieve the 4 hour as-sintered fine grain condition. Once in the fully dense small grain equi-axed condition, uni-axial loading may be applied as described/shown in patent application U.S. Ser. No. 15/530,951 and in FIG. 11 to assist in abnormal grain growth control. A 75 g load (tungsten weight) was applied in this example in the z-direction (vertical direction) during the uni-axial stressing as shown in FIG. 12 during secondary vacuum sintering at 1250° C. A near-single crystal specimen resulted with a single orientation that aligned with the [111] direction. Although a low applied stress in this case was applied, the final grain orientation was like that of the high-stress case where a creep dominant mechanism was previously observed with significant plastic deformation. This orientation shift shows that the preliminary templating of the powder from the external magnetic field during the initial compression molding provided the primary grain orienting mechanism and that the low applied stress merely served to drive the abnormal grain growth process to completion in its magnetically aligned direction. Thus, the final (single crystal) orientation was not set by a creep or grain boundary energy biasing mechanism, but rather by the applied magnetic field direction during initial compression molding.

This critical difference as it relates to the grain growth mechanism can be applied to derive the desired final orientation of the magnetic easy-axis direction and sample geometry. By knowing the desired orientation, one can calculate (e.g., in a cubic system such as alnico) the angle between the resulting [111] direction and the desired [001] direction (54°) and for a cubic crystal system and simply adjust the applied field direction by that angle or its compliment (36°). However, a similar practice could be applied to any crystal system with similar grain boundary surface energies and operating crystal symmetry.

Magnetic properties reported for the 75 g uni-axially loaded single crystal specimen are consistent with the perfect [111] orientation (which orientation is non-optimal) and are quite low. That is, the magnetic remanence is severely diminished and accordingly the remanence ratio, reflecting the severely off-ideal orientation of the resulting magnet (Table 2). The remanence of 7.27 kG and remanence ratio of 0.63 also reflects the large misorientation of the sample away from the desired ideal <001> direction. While the magnitude of the reported properties is low, the correlation with the expected result for a [111] single crystal is very high and consistent.

TABLE 2

Magnetic properties for field aligned textured magnet samples using either permanent magnet or Halbach array. Angle described as 0 degrees is perpendicular to pressing direction, 90 degrees is parallel to pressing direction, and blank entry is no applied field.

| Angle (Deg) | Stress (kPa) | Br (kG) | Hci (Oe) | BHMax (MGOe) | Remanence Ratio (Br/Ms) |
|---|---|---|---|---|---|
| 90 | 104 | 7.27 | 1,459 | 3.1 | 0.63 |
| 54 | 277 | 9.3 | 1,637 | 6.0 | 0.78 |
| 54[1] | 277 | 9.1 | 1,794 | 6.0 | 0.75 |
| 54 | 277 | 9.3 | 1,731 | 6.0 | 0.78 |
| 45 | 277 | 9.8 | 1,594 | 5.97 | 0.77 |
| 36[1] | 277 | 9.1 | 1,781 | 5.95 | 0.76 |
| 36[1] | 277 | 9.3 | 1,781 | 6.3 | 0.78 |
| 0 | 277 | 8.8 | 1,697 | 5.2 | 0.70 |
| DEAD-WEIGHT ONLY+ | 277 | 8.6 | 1,680 | 5.2 | 0.70 |
| MMPA STD ALNICO 8HC | — | 6.7 | 2,020 | 4.5 | *0.70 |

+Smaller powder, AGG already occurred before DWL
*Estimated
[1]1 h sinter vs. 2 h sinter before DWL

Example 2. Halbach Array Magnetic Particle Templating

Figure 7A:
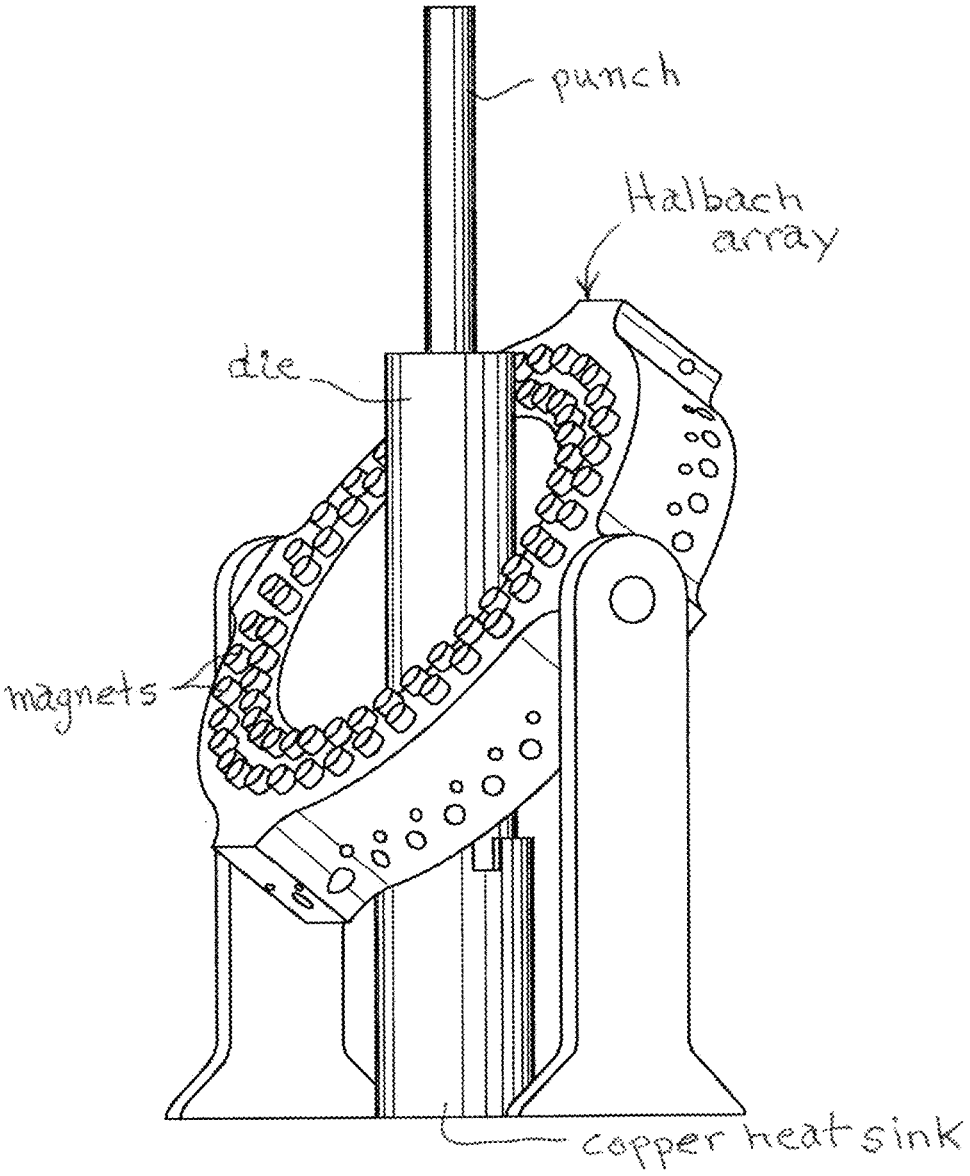
FIG. 7*a* shows a Halbach array tilted at 54° with a titanium die and an attached copper heating fixture that has a resistive heating collar clamped in place.
Figure 7B:
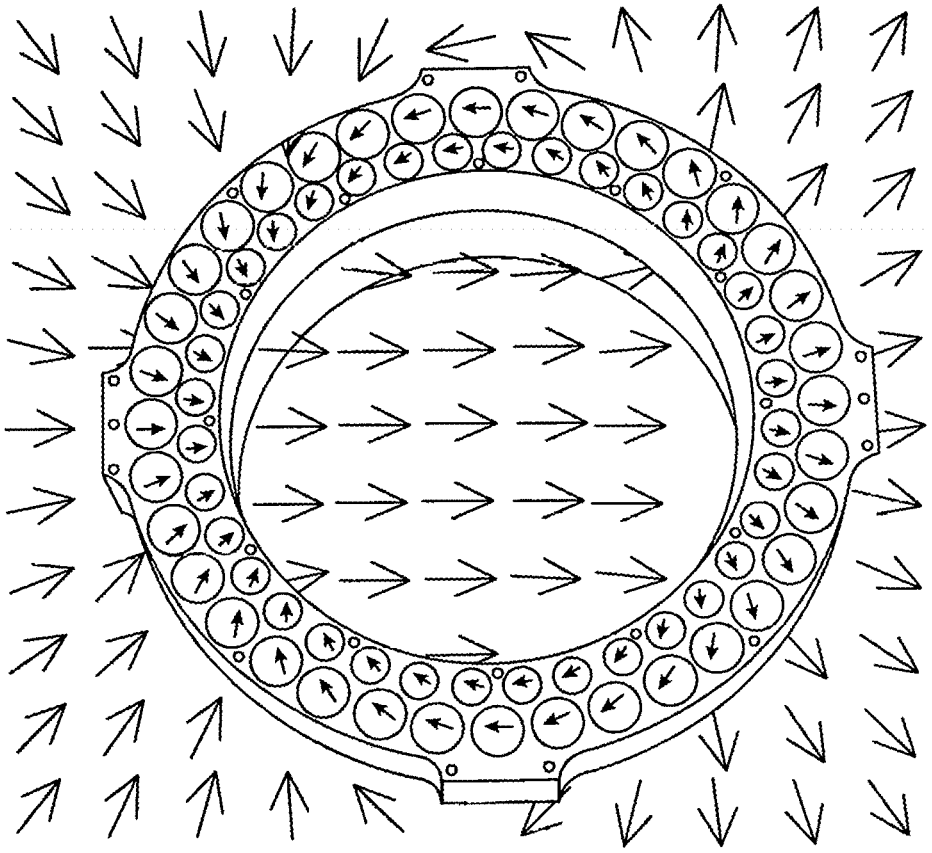
FIG. 7*b* shows the flux field simulation of a similar Halbach design.

A Halbach array was designed based on a similar design to that used by "PERDaix" (Proton Electron Radiation Detector Aix-la-Chappelle) using 7075 aluminum and N52 grade Neodymium Iron Boron based magnets to give a highly controlled external magnetic flux field which could be passed through a nonmagnetic titanium and bronze alloy based die [reference 4-PERDAaix. Magnet PERDaix. vol. 2017, 2014]. Halbach arrays are known for their ability to simultaneously nearly eliminate the field on one side of the desired direction while enhancing greatly the magnetic flux on the opposing side. The design used in these experiments (FIG. 7*a*) is a type k=2 where a uniform north south flux is created across the transverse gap of a cylindrical array (FIG. 7*b*) [reference 5]. Flux was measured in the bore of the completed Halbach array using a Hall Probe, giving an average value of 0.2 T at the midpoint of the interior of the array (FIG. 7*a*, 7*b*). Approaching any one extreme (edge) would increase the value of the field to 0.75 T or greater. The Halbach array design itself was created such that the specimen being treated was auto-centered in the array during tilt. Further, the angle created at maximal tilt was specifically designed to be exactly 54° in these experiments. This value was determined to be the optimal tilt from example 1 to maximize the templating effect in the proper direction. As the sample is centered in the array and doesn't move laterally in any direction relative to the field or along a z-axis (height) the field should be consistent at all tilt angles.

Figure 8A:
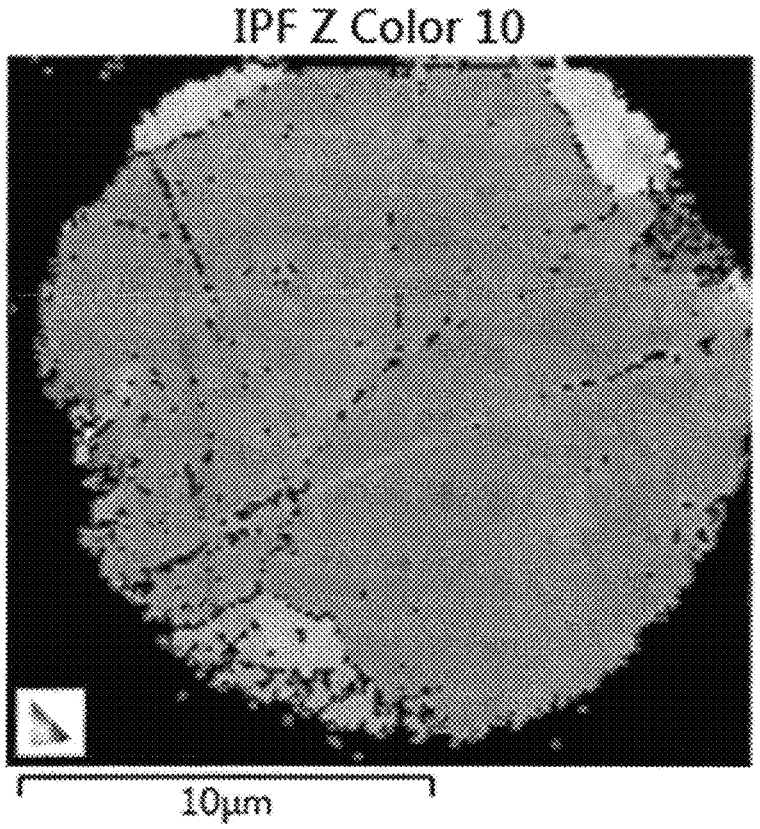
FIG. 8*a* gives the EBSD orientation map of the cross-section of a 17 μm particle, indicating a nearly bi-crystal powder particle.
Figure 8B:
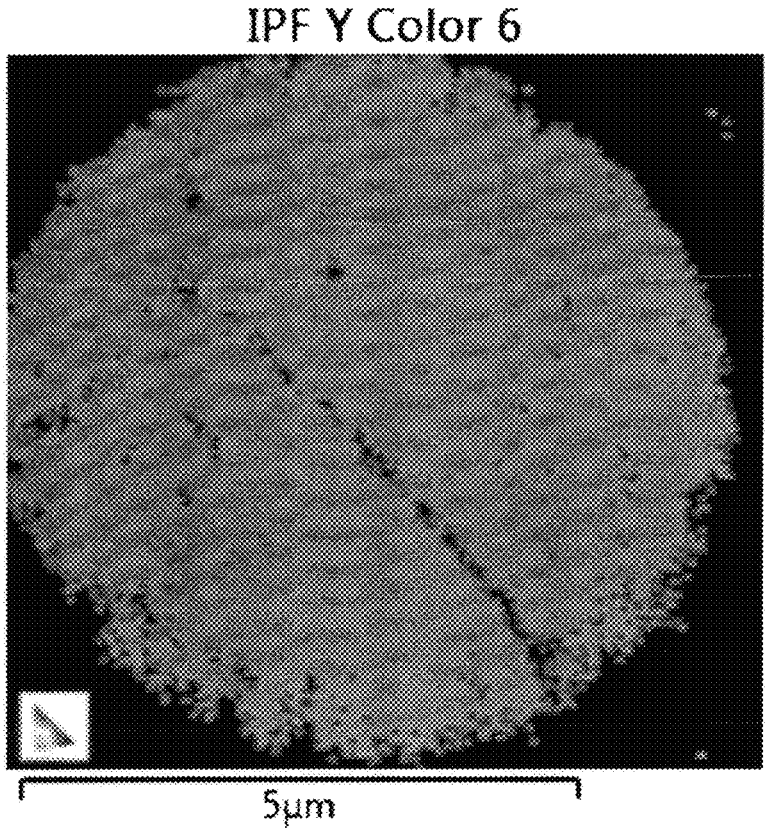
FIG. 8*b* gives the EBSD orientation map of the cross-section of an 8 μm particle, indicating a single crystal powder particle.
Figure 9:
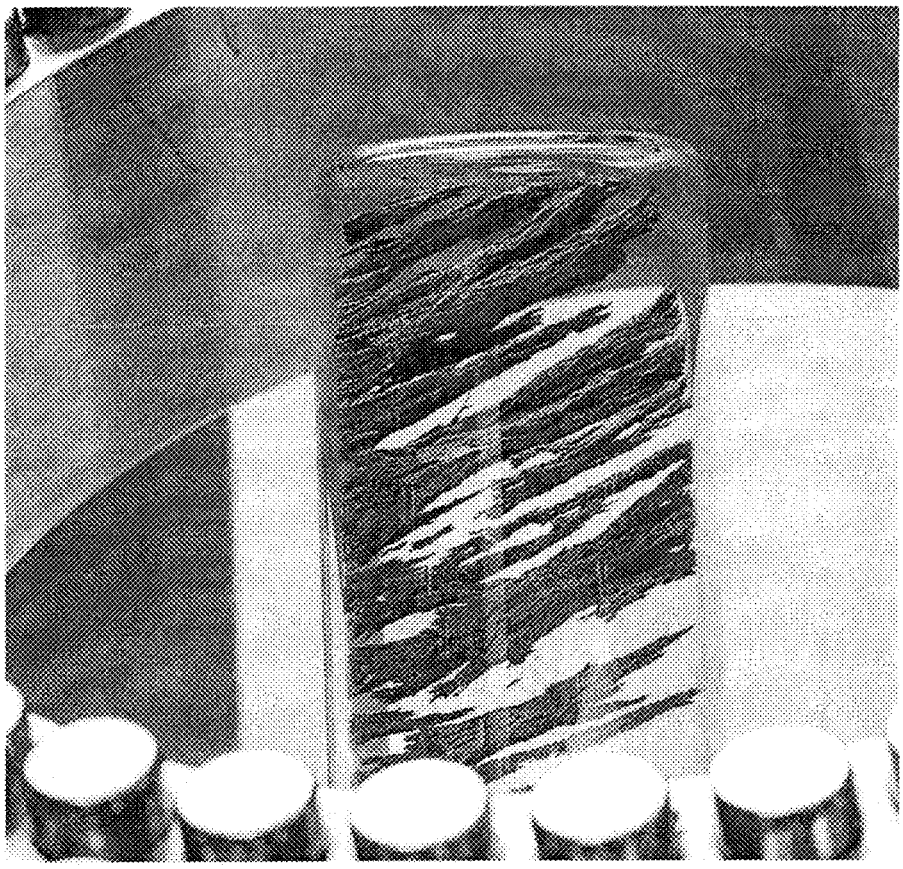
FIG. 9 illustrates alnico powder inserted into Halbach array magnetic field showing uniformity of field, as well as the pole-to-pole chaining effect described as an underlying mechanism of templating.

The pressing die was constructed from Ti-6Al-4V to ensure that no magnetic flux was suscepted, which would destroy the field uniformity. Further, a copper "pin-vise" collar with integrated post was band-clamped on the bottom of the die to permit attachment of a band (resistance) heater to be used for preheating the die to 60° C. (well above the glass transition temperature of the PPC binder) for pressing of the green body using opposing punches in the die (only one shown in FIG. 7*a*). Die heating to a temperature of above the glass transition temperature (40° C. for the PPC binder in this example) but below the binder decomposition temperature (140° C.) was used to increase particle mobility (by a lubrication effect) and further enhance the effect of the applied magnetic field and particle motion as well as to enhance densification of the green body and final sintered body. A smaller powder size was used in these experiments (dia. <20 μm). This finer powder was used to enhance control of templating by reducing the number of competing grains in any one powder particle (FIGS. 8*a* and 8*b*). The particle alignment effect can be observed clearly if a ferrofluid or magnetically responsive materials are placed in the field, where chaining and layering are clearly observed (FIG. 9). FIG. 8*a* shows nearly bi-crystal powder, while FIG. 8*b* shows the EBSD orientation map that indicates a single crystal powder particle.

Figure 10:
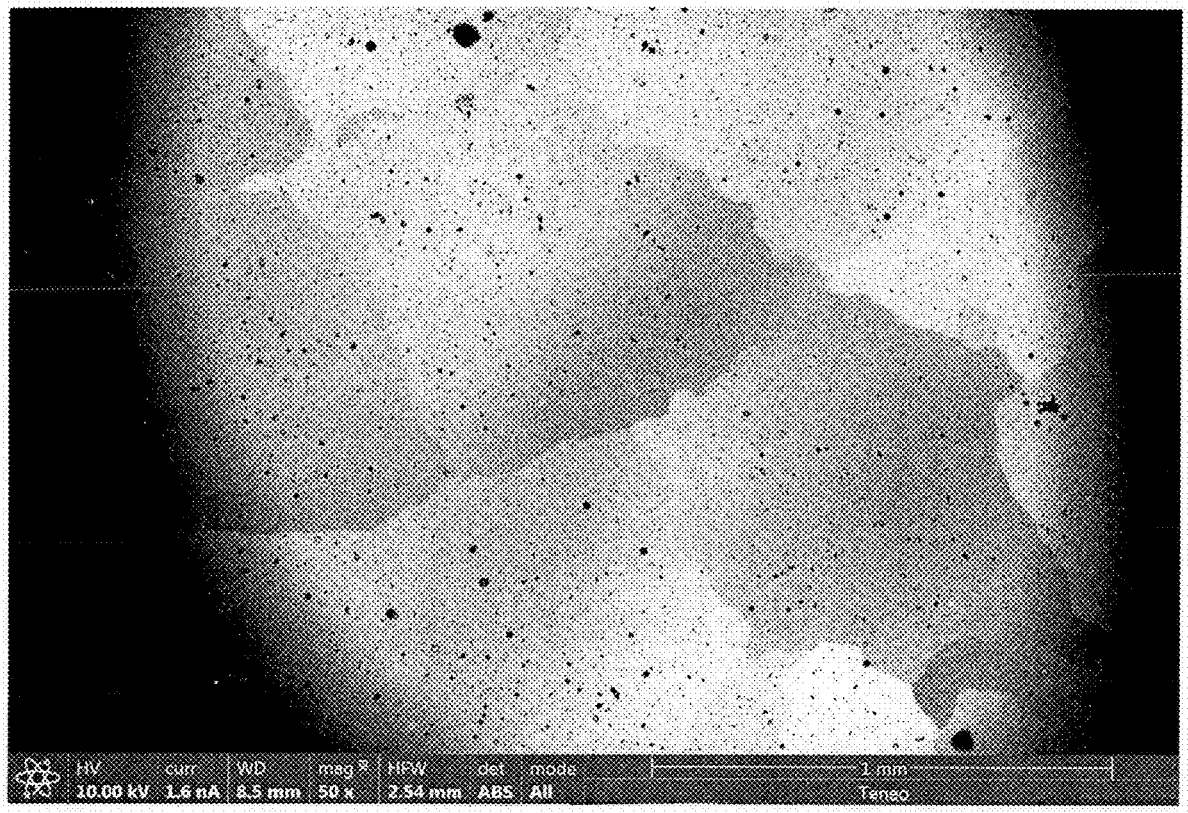
FIG. 10 shows the grain size after sintering for 4 hours, revealing grains already greater than 1 mm, for a starting powder size of less than 20 μm.

Samples were processed as in Example 1, with the exception of the field angle change from 90° to 54°. Further, the powder sample was ultrafine (dia. <20 μm) versus that of example 1 with blended 32-38 um (90%) powder. The powder sample was introduced into the unheated die by hand with a spatula, while tapping the die by hand with a rod. After the die was loaded to a predetermined level with the binder-coated powder sample, the die was heated to 60° C. by the attached resistance heater, a compressive load was applied by the punch on the powder sample of 156 MPa, and the sample was cooled to room temperature under the compressive load. After removal of the compact from the die, subsequent thermal debinding and sintering steps were performed on each sample, as described above. It was observed that the smaller sized powder dramatically enhanced the rate of abnormal grain growth (AGG) for the typical 4 hour+4 hour (initial+secondary) sintering schedule that was followed compared to the coarser powder size fraction that was used in example 1 (FIG. 10).

Figure 11:
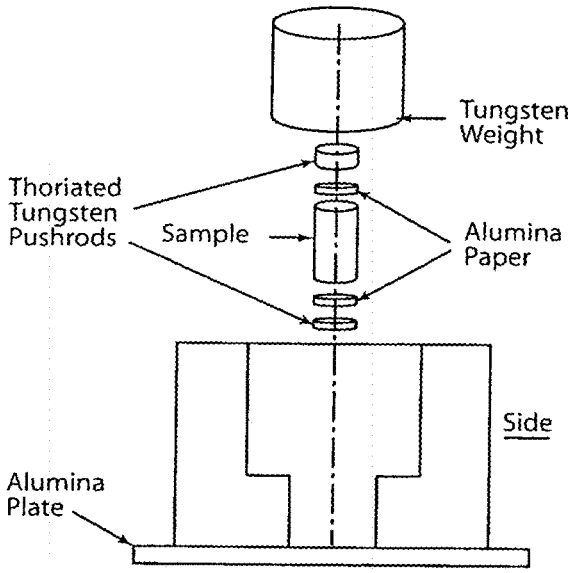
FIG. 11 is a schematic that shows an exploded view, with partial a side view portion, of a uni-axial loading apparatus used to texture rod-shaped alnico samples using a compression load. The apparatus employed a tungsten weight, thoriated tungsten pushrods, alumina paper (diffusion barrier) discs between the sample and the pushrods, and a machinable alumina support body (partial side view). The apparatus rests on an alumina ceramic support base shown.

For the secondary sintering treatment under a fixed "low" uni-axial stress, a 200 g (277 kPa) load (tungsten weight) was applied to the specimens following the procedure as shown/described in FIG. 11 and patent application Ser. No. 15/530,951. However, since grain size on these specimens was already rather large (FIG. 10), the resulting creep from the applied load was nearly zero (<1%). This means that the applied load had minimal influence on changing the orientation of the resulting microstructure, since both the initial field alignment during compression molding and the subsequent uni-axial stress biasing were "pointed" in the same direction. Rather, the uni-axial stress level only acted to promote further grain growth while under a grain boundary energy biasing effect in the same direction. The effect of the initial magnetic templating can be further highlighted when specimens are compared to companion specimens that were processed with an "off-aligned field" (Table 2). The off-aligned companion specimens showed a distinct reduction in all magnetic properties, e.g., remanence, remanence ratio, squareness, and energy product that was not able to be changed by the uni-axial stress biasing during secondary sintering.

Further, it was also observed that a significant enhancement in remanence, remanence ratio, squareness, and energy product was achieved over the baseline for the alloy and the MMPA standard alnico, as well as over the first misaligned sample (Example 1). Further, the properties attained by these two samples approached or met those measured in the 8 hour demonstration samples from the Table 1. This magnetic property improvement further reinforces the overall benefit of the applied magnetic field in the designed direction during compression molding on the development of a properly aligned microstructure, perhaps even acting alone without the uni-axial stress biasing during secondary sintering.

References which are incorporated herein by reference:

[1] Anderson I E, Byrd D, Meyer J. Materialwiss. Werkstofftech. 2010; 41:504.

[2] Madeline Durand-Charre C B, Jean-Pierre Lagarde. IEEE Transactions on Magnetics 1978; 14.

[3] Makino N, Kimura Y. J. Appl. Phys. 1965; 36:1185.

[4] PERDAaix. Magnet PERDaix. vol. 2017, 2014.

[5] Bjork R, Bahl C R H, Smith A, Pryds N. J. Magn. Magn. Mater. 2010; 322:3664.

[6] Standard M. Standard for Permanent Magnets, MMPA Standards 0100-00. Magnetic Materials Producers Association.

Although the present invention has been described with respect to certain illustrative embodiments, those skilled in the art will appreciate that changes and modifications can be made therein within the scope of the invention as set forth in the appended claims.

We claim:

1. A method of making a permanent magnet, comprising compacting spherical magnet alloy particles all having a diameter less than about 20 microns in the presence of a binder in a die cavity and in the presence of an exterior magnetic field that is applied at the beginning of and during at least initial compacting to exert an alignment torque on the alloy particles wherein the magnetic field is applied at an acute tilt angle relative to the compacting direction that a magnetic flux field direction extends acutely in diagonal manner all the way across the die cavity and the alloy particles therein to align the alloy particles with a preferential grain texture to form a compact in which the preferential grain texture of the alloy particles is locked in place by the binder, and heat treating the compact to achieve grain growth in the compact in a direction of the preferential grain texture within at least a portion of the volume of compact.

2. A method of making a permanent magnet, comprising compacting binder-coated spherical magnet alloy particles in a compact-forming die cavity wherein the particles all have a diameter less than about 20 microns in the presence of an exterior magnetic field that is applied at the beginning of and during at least initial compacting to exert an alignment torque on the alloy particles and wherein the magnetic field is applied at an acute tilt angle relative to the compacting direction that a magnetic flux field direction extends acutely in diagonal manner all the way across the die cavity and the alloy particles therein to align the binder-coated alloy particles with a preferential grain texture to form a compact in which the preferential grain texture of the alloy particles is locked in place by the binder coating, removing the compact from the compact-forming device, and heat treating the compact to achieve grain growth in the compact in a direction of the preferential grain texture within at least a portion of the volume of compact.

3. The method of claim 1, wherein the magnetic field is applied at the beginning of and during compacting until the preferential grain texture is locked in place in the compact.

4. The method of claim 1 wherein the magnet alloy particles are heated during compaction.

5. The method of claim 4 wherein the magnet alloy particles are heated to increase particle mobility during compaction.

6. The method of claim 1 wherein the particles comprise alnico powder.

7. The method of claim 1 wherein the particles comprise binder-coated particles.

8. The method of claim 7 wherein the binder-coated particles have a polymer binder coating on the particles.

9. The method of claim 8 wherein the polymer binder is polypropylene carbonate.

10. The method of claim 8 wherein the polymer binder is heated above the polymer glass transition temperature during compaction and cooled below the glass transition temperature after compaction to lock the preferential grain texture of the alloy particles in place.

11. The method of claim 1 wherein the particles include an oxide coating on the individual particles beneath a particle binder coating.

12. The method of claim 1 wherein the magnetic field applied to the particles is about 1 Tesla or less.

13. The method of claim 1 wherein the magnet alloy particles arc compacted in a compact-forming non-magnetic die.

14. The method of claim 1 wherein the magnet alloy particles are compacted in a compression molding die or an injection molding die.

15. The method of claim 1 including an additional step of uniaxial loading of the compact during the heat treating step to further enhance the microstructural grain texture effect by solid state grain growth.

16. The method of claim 1 wherein the magnet alloy particles comprise, in weight %, about 7 to about 8% Al, about 13 to about 15% Ni, about 24 to about 42% Co, up to about 3% Cu, up to about 8% Ti, and balance Fe and incidental impurities.

17. The method of claim 16 wherein the magnet alloy particles comprises, in weight %, 7.1% Al, 13.0% Ni, 40.1% Co, up to 3.0% Cu, up to 6.5% Ti, up to 0.5% Nb, and balance substantially Fe and incidental impurities.

* * * * *